United States Patent [19]

Siegal

[11] 4,450,498

[45] May 22, 1984

[54] ELECTRICALLY GROUNDED, STATIC ABSORBING DRAPERY INSTALLATION

[75] Inventor: Burton L. Siegal, Skokie, Ill.

[73] Assignee: Coral Industrial Sales Co., Chicago, Ill.

[21] Appl. No.: 418,243

[22] Filed: Sep. 15, 1982

[51] Int. Cl.[3] ..... H05F 3/02

[52] U.S. Cl. ..... 361/212; 361/216

[58] Field of Search ..... 361/212, 220, 216

[56] References Cited

U.S. PATENT DOCUMENTS

| | | | |
|---|---|---|---|
| 2,325,414 | 7/1943 | McChesney et al. | 361/216 X |
| 3,084,700 | 4/1963 | Fischer et al. | 361/220 X |
| 3,288,175 | 11/1966 | Volko | 361/212 X |
| 3,678,675 | 7/1972 | Klein | 361/220 X |
| 3,839,135 | 10/1974 | Lowry et al. | 361/220 X |
| 4,398,277 | 8/1983 | Christiansen et al. | 361/212 X |

*Primary Examiner*—Harry E. Moose, Jr.

*Attorney, Agent, or Firm*—Silverman, Cass & Singer, Ltd.

[57] ABSTRACT

An electrically grounded, static absorbing drapery installation which employs a decorative conductive drapery fabric having disconnectable electrical connector means installed thereon for connection to the ground terminal of a conventional wall outlet for dissipating accumulated static charge. The electrical connector means do not interfere with opening and closing of the drapery in its installed condition. Also the electrical connector means can be selectively disconnected to permit cleaning or repair of the drapery.

11 Claims, 5 Drawing Figures

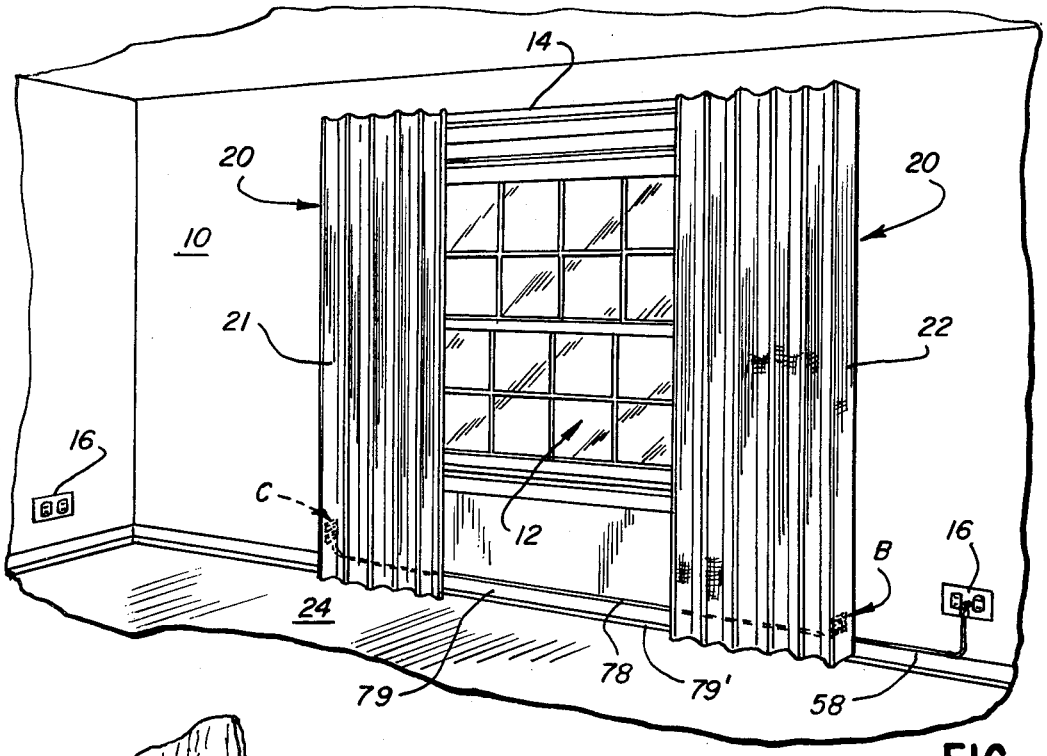
FIG. 1
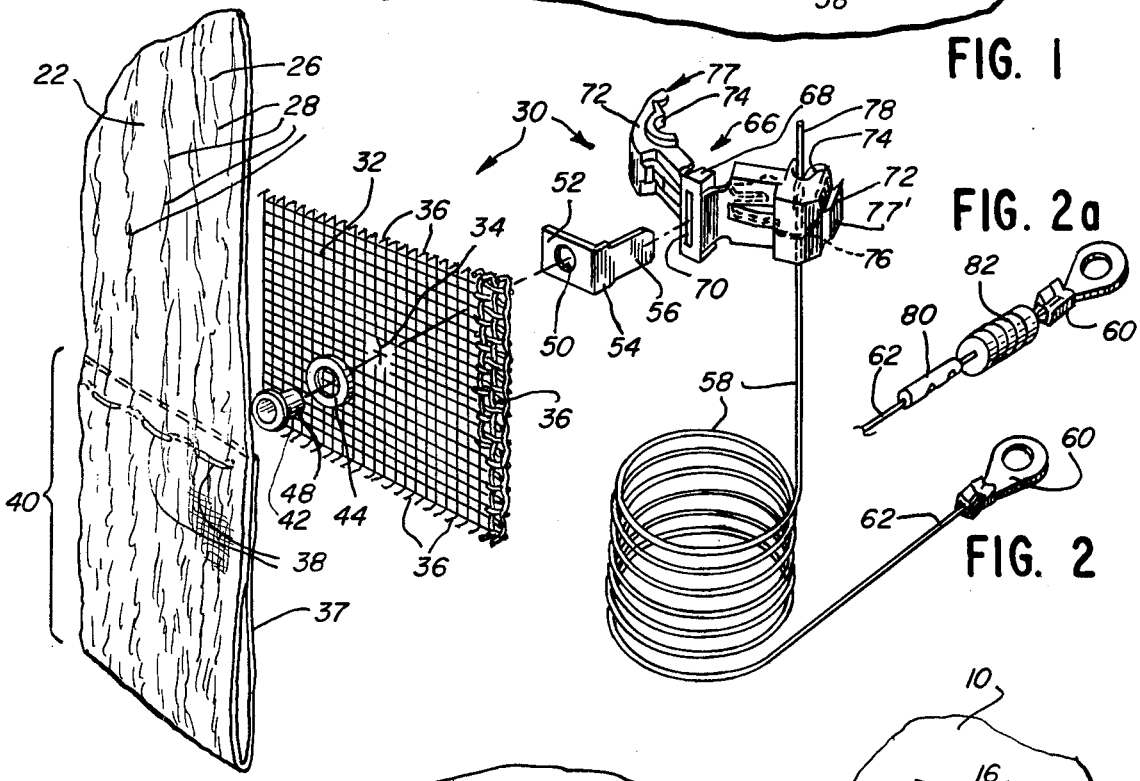
FIG. 2a
FIG. 2
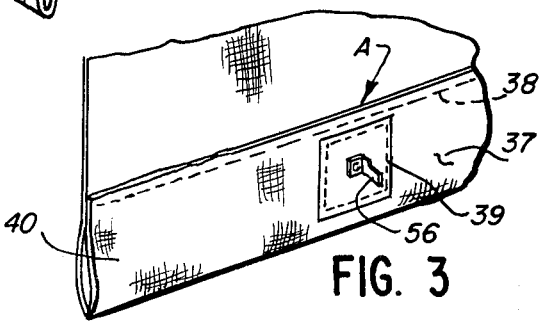
FIG. 3
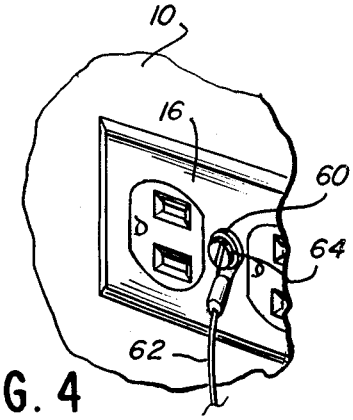
FIG. 4

ELECTRICALLY GROUNDED, STATIC ABSORBING DRAPERY INSTALLATION

BACKGROUND OF THE INVENTION

This invention relates specifically to electrically grounded, static absorbing drapery having novel electrical connector means which permit practical usage of a decorative conductive fabric for a conventional drapery installation in a home, office or other business facility for dissipating accumulated static charge.

It is known to be desirable in many industrial operations to be able to dissipate accumulated static electricity or to prevent their accumulation before a dangerous voltage can be generated. Recognition of this problem has resulted in focusing of efforts to provide improved flooring and carpeting having static discharge capability. U.S. Patents concerned with this technology are Nos. 2,184,811; 2,302,003; 2,323,461; 2,325,414; 2,456,373. U.S. Pat. No. 4,153,749 is concerned with providing an anti-static carpet.

Of interest also are U.S. Pat. Nos. 2,640,143 and 3,378,726 concerned with seat covers of automobiles which seek to prevent accumulation of undesirable static charge.

In the home or office which is carpeted, the familiar experience of an electrical shock after traversing the carpet needs no elucidation. To applicant's knowledge, such familiar static charge dissipating or preventing technology has not been applied to drapery installations in homes or offices. This invention is specifically directed to a novel drapery installation in which a decorative conductive fabric suitable for a window drapery is grounded by disconnectable electrical connector means which do not interfere with optimum use of the drapery. An important feature of said electrical connector means is that component parts designed for electrical installation on the drapery fabric can be provided as an assembled unit which is easly installed.

SUMMARY OF THE INVENTION

According to the invention, there is provided a drapery installation in which a suitable decorative drapery fabric fabricated to be electrically conductive by conventional techniqes is grounded to a conventional wall outlet for leaking accumulated static charge to ground. Novel electrical connector means which is selectively disconnectable is attached on the drapery panels in a manner which does not interfere with opening and closing of the drapery. The drapery panels can be taken down to be cleaned, as needed, and re-installed conveniently and effectively without dissembling said connector means completely from the drapery panels.

The electrical components to be installed on the drapery fabric in electrical connection therewith are assembled for easy installation without requiring undue skill.

BRIEF DESCRIPTION OF THE DRAWINGS

FIG. 1 is a perspective view of a drapery installation embodying the invention;

FIG. 2 is a fragmentary perspective view of a drapery panel in which the electrical connector means of the invention is shown in exploded detail.

FIG. 2*a* is a fragmentary perspective view of a modified terminal member for the grounding wire seen in FIG. 2.

FIG. 3 is a fragmentary perspective view taken from the rear face of a drapery panel showing the electrical connector means installed with its terminal disconnected from the electrical conductor grounding wire seen in FIG. 2.

FIG. 4 is a fragmentary perspective view showing the grounding wire having its eyelet terminal connected to the grounding terminal of a conventional wall outlet.

DESCRIPTION OF THE PREFERRED EMBODIMENT

Referring to FIG. 1, there is illustrated a wall 10 having a window 12 therein of conventional construction. Spanned across the top of and spaced from the window 12 is illustrated a conventional draw drapery rod 14. Spaced from the window 12 is illustrated a conventional electrical wall outlet 16. Framing the window 12 along opposite vertical runs thereof in a conventional appearing manner is the drapery installation embodying the invention designated generally by the reference character 20.

Said drapery installation 20 is comprised of a pair of drapery panels 21, 22 of textile fabric which has been woven, knitted, tufted or braided using standard techniques of desired length so as to hang gracefully from rod 14 to the floor 24. The manner of hanging the drapery panels 21, 22 from rod 14 is conventional, such as, by means of pins affixed to a hem at the top end of the drapery panel which are suspended from traverseable lugs on the rod 14. These lugs usually are formed of a synthetic plastic material.

The textile fabric from which panels 21, 22 are fabricated is represented generally by reference character 26 in FIG. 2. In accordance with the invention, electrically conductive fibers or filaments 28 of continuous length are fabricated with the textile fabric by conventional methods. These conductive fibers commonly would be less than 1% of the textile fabric used. The conductive fibers preferably would be woven in a grid-like pattern and spaced from ½ inch to 2 inches on centers depending upon the degree of static protection desired. The filaments would be of very fine metal or metal coated strands which preferably are invisible to the naked eye so as not to detract from the pattern or design of the textile fabric. This is particularly desirable in the drapery fabric field in which textile fabric swatches are provided by suppliers to their customers from which to make fabric selections. Thus, even conventional swatches of fabric can continue to be used even though they may not be of conductive fabric characters because the conductive filaments would be substantially invisible. However, even conductive filaments having colored or patterned surfaces could be used since the invention requires that the conductive fibers or filaments employed be continuous through the drapery fabric of the panel.

Referring to FIGS. 2 and 3, the electrical connector means is designated generally by the reference character 30. Said means 30 is comprised of a metal plate 32 having a medial aperture 34 therethrough. In the illustrated embodiment, plate 32 is a mesh or screen member whose perimetric edges 36 have been bent at approximately 90° relative to the main body thereof. These edges 36 can be seen to be tapered or pointed so that when the plate 32 is juxtaposed the fabric 26, they engage the fabric and make electrical contact with the conductive filaments 28. The edges 36 also are intended to be crimped into the fabric strands for retaining the plate 32 on the fabric 26. It will be appreciated that the conductive fibers 28 also will make electrical contact with the face of the plate 32. In FIG. 2, the plate 32 is poised for engaging fabric 26 of panel 22 on the surface 37 facing inwardly or toward a wall 10 below the hemming stitches 38 of hem 40 at the bottom end of the drapery panel. This corresponds to position or location designated A in FIG. 3. Of course, electrical contact between plate 32 and these filaments 28 is the desired goal. To improve the retention of plate 32 to surface 37, the plate can be basted to it with basting stitches 39.

A metal grommet 42 is passed through washer 44 and aperture 34, the grommet having a shaft 48 of sufficient length to protrude beyond the plate 32. The shaft 48 is extended through the aperture 50 in the leg 52 of the right angle terminal member 54 and will be swaged or otherwise crimped thereto to make electrical contact therewith. Terminal member 54 has a terminal leg 56 of rectangular configuration. It is intended that components 42, 44, 32, and 52 be assembled as a kit provided ready for installation on a drapery panel 21 and/or 22.

Seen in FIG. 2 is a coil of electrical conduit or wire 58 having a ring terminal 60 assembled to an end 62 thereof. The length of the wire 58 is optional so long as it permits installation from the drapery to an outlet 16 as seen in FIG. 4 where terminal ring 60 is connected to the ground terminal 64 of the outlet 16. Also, as will be explained, the length of wire 58 can be selected to enable it to be used also for grounding of the panel 21 to the same outlet 16.

To connect conductor 58 to terminal 56, there is employed a conductive terminal member designated generally 66. Member 66 has a central body formation 68 provided with a slot 70 therethrough suitably dimensioned to accommodate the terminal leg 56. Extending from opposite sides of the formation 68 is a pair of wing formations 72 which are pivotal relative to formation 68. Each wing 72 has an arcuate seat 74 for receiving a length 76 of conductor 58, as seen in FIG. 2. Insulation piercing tines or prongs, not shown, are provided in the seats 74 which will pierce the insulation of wire 76 when the wings 72 are pinched together in an obvious manner to electrically connect terminal 66 to the conductor 58. No pliers or other tool is required for this operation. When terminal leg 56 is engaged with terminal 66 through slot 70, the conductive fabric 26 is connected through plate 32 to conductor 58 which can then be grounded through ring terminal 60 to ground terminal 64. The wings 74 have cooperating latch members 77, 77' to keep wings 72 closed on the conductor 58.

Referring to FIGS. 1 and 2, it will be noted that there is illustrated a representative excess length 78 of conductor 58 extending from terminal member 66. As represented in FIG. 1, the conductor length 78 is extended from the electrical connector installation 30 on drapery panel 22 designated B along the base board 79 to a like electrical connector installation 30 designated C on panel 21.

As seen in FIG. 1, each drapery panel 21, 22 is grounded through a conductor 58 to an outlet 16. The position or location of the electrical connector means at the stationary end of a panel permits opening and closing of the drapery installation freely without interfering with the connection to ground for dissipating electrical charge accumulated on the drapery furing normal usage. This location also facilitates running the conductor 58 along the base board 79 or on cove molding 79' of wall 10 in such a manner as to be as inconspicuous as possible. Of course, installation C also is a feasible one.

Referring to FIG. 4, to take the drapery panels 21, 22 of the rod 14 for cleaning or repair purposes, one need only withdraw the terminal leg 56 from terminal 66. Thereafter, remaking the desired electrical connection after the drapery panels are repaired or cleaned is a simple matter of again inserting terminal 56 into slot 70 of terminal 66.

Referring to FIG. 2*a*, it is feasible to insert a suitable resistor connected between lead 62 and eyelet 60. Such a resistor could be a one megohm resistor 80, for instance, held in a crimp coupler 82, which would provide electrical shock protection to prevent passing high voltage, high current shocks that could be dangerous. Yet, static charges of 2,000 plus volts would still be able to be leaked to ground terminal 64 unimpeded by the resistor.

It will be appreciated that the drapery installation embodying the invention is feasible with a single drapery panel of suitable dimension to span a window with which it is hung. Also, although a single conductor 58 has been described and illustrated in the preferred embodiment, it will be appreciated that where outlets 16 are provided on opposite sides of a window, a separate conductor 58 may be used each connected separately to the ground terminal of an outlet 16.

The invention is not restricted to any particular drapery fabric other than the use of a continuous electrical path for dissipating static charge through the means 30. This would be realized with the grid-like pattern used for the conductive fibers 28. The pitch or spacing of the conductive fibers 28 may vary widely with different applications. The conductor wire 58 may vary within wide limits depending upon the nature of the insulation desired for aesthetic or decorative purposes. Also, there may occur minor variations in design features of the electrical terminals used without departing from the intended operational functions and purposes of the combined component parts of the invention.

I claim:

1. In a drapery installation which includes at least one panel of decorative fabric having electrically conductive fibers or filaments fabricated thereinto; said fabric panel being adapted to be hung from a traverse rod with one side edge geneally vertically stationary and a second side edge to be traversed thereby; an electrical connector assembly of component parts strategically installed on the panel for minimal movement therewith during opening and closing of the drapery comprising:

(a) electrically conductive plate means secured to a face of said panel adjacent said generally stationary side edge in electrical connection with said conductive fibers or filaments;

(b) a first terminal member secured in electrical connection to said plate means;

(c) a second terminal member electrically connected to said first terminal member and selectively disconnectable and reconnectable therewith without dissembling the plate means from the panel; and (d) an elongate electrical conductor member having an end terminal member for connecting said conductor to ground;

(e) said conductor being electrically connected to said second terminal member to electrically ground said panel for dissipating static electric charge accumulated on the panel to said ground without interfering with optimum movement, use and cleaning of the drapery.

2. In a drapery installation as described in claim 1 in which said plate means comprises a metal mesh member of rectilinear configuration.

3. In a drapery installation as described in claim 2 in which said mesh member has marginal edges deformed angularly relative to the planar body thereof and said edges are engaged into the fabric of the panel for retaining said mesh member on the panel.

4. In a drapery installation as described in claims 1 or 2 in which said first terminal member is a right angle member having one leg secured to the plate means and a second leg providing a terminal leg of the said member, said second terminal member having an electrical socket or slot form releasably receiving said second terminal leg therein.

5. In a drapery installation as described in claim 1 which includes a second fabric panel of like electrical conductive fabrication as the first mentioned panel, a like electrical connector assembly installed on the second panel, said conductor connector having an extension thereof electrically connected to said like connector assembly whereby both panels are connected to ground through the same conductor member.

6. In a drapery installation as described in claims 1 or 5 in which said conductor member is connected to the ground terminal of a common wall outlet.

7. In a drapery installation as described in claim 5 in which said like electrical connector assembly includes a second conductor connecting the second panel to ground through a wall outlet.

8. In a drapery installation as described in claims 1 or 5 in which a resistor is connected between the conductor and ground of selected ohm value for eliminating electrical shock.

9. In a drapery installation as described in claim 1 in which said conductive fibers are fabricated in a gridpattern to provide a continuous electrical path to said connector means.

10. In a drapery installation as described in claim 1 in which said panel has a bottom hem and the assembly is installed on said hem facing away from the exterior face of the panel.

11. In a drapery installation as described in claim 1 or 2 in which said assembly is secured to the panel by basting thread thereto.

* * * * *